US007225594B2

(12) United States Patent
Karlström et al.

(10) Patent No.: US 7,225,594 B2
(45) Date of Patent: Jun. 5, 2007

(54) STUD SYSTEM AND METHODS RELATED THERETO

(76) Inventors: Johan Tore Karlström, Vikingränd 6, FIN-22150 Jomala (FI); Johan Mikael Karlström, Skarpansväen 27 C 7, FIN-22100 Mariehamn (FI)

( * ) Notice: Subject to any disclaimer, the term of this patent is extended or adjusted under 35 U.S.C. 154(b) by 0 days.

(21) Appl. No.: 10/332,985

(22) PCT Filed: Jul. 26, 2001

(86) PCT No.: PCT/FI01/00684

§ 371 (c)(1),
(2), (4) Date: Mar. 25, 2004

(87) PCT Pub. No.: WO02/10531

PCT Pub. Date: Feb. 7, 2002

(65) Prior Publication Data

US 2004/0148902 A1 Aug. 5, 2004

(30) Foreign Application Priority Data

Jul. 27, 2000 (SE) ..... 20001716

(51) Int. Cl.
*B27B 1/00* (2006.01)
*B27M 1/08* (2006.01)
*E04C 3/30* (2006.01)

(52) U.S. Cl. ..... 52/730.7; 52/745.19; 52/730.1; 52/589.1; 52/588.1; 144/330; 144/345; 144/346; 144/354; 144/359; 144/360; 156/264; 156/260; 428/106; 428/114

(58) Field of Classification Search ..... 52/233, 52/720.1, 720.2, 730.7–731.9, 737.1, 745.1, 52/730.1, 729.4, 589.1; 156/264, 260, 259, 156/257, 268; 144/330, 378, 359–360, 345–347, 144/354–355; 428/106–110, 114, 172, 535
See application file for complete search history.

(56) References Cited

U.S. PATENT DOCUMENTS 178,989 A * 6/1876 Brock ..... 144/347

(Continued)

FOREIGN PATENT DOCUMENTS

DE G 91 07 760.5 10/1992

(Continued)

OTHER PUBLICATIONS

Finnish Utility Model Application No. U920048 (partial translation—abstract).

*Primary Examiner*—Jeanette Chapman
(74) *Attorney, Agent, or Firm*—Arent Fox LLP

(57) ABSTRACT

The present invention relates to a stud system where each respective stud (2) includes flanges (4, 4*a*) which are directly attached to each other and which constitute an essentially monolithic entity. Said flanges are formed of a wane edge wood material (3) in such a manner that each respective flange includes a bevelled side portion (6) which is directed towards the inner portion of said stud. A side portion is formed as a contact surface (8) for intermeshing co-operation with a corresponding contact surface (8) at an adjacent flange. The present invention also relates to a method for manufacturing such studs where a first flange strip (4) is formed to include a generally toothed first contact surface (8) which is arranged in an inter-mesching disposition with a corresponding contact surface (8) at a corresponding second flange strip (4*a*). Further, the present invention relates to a method at such stud systems. A side portion of respective opposite flanges (4, 4*a*) are formed to include longitudinal tongue structures and two opposite flanges (4, 4*a*) are compressed so that said opposite tongue structures will be positioned in a mutually intermeshing disposition.

10 Claims, 4 Drawing Sheets

U.S. PATENT DOCUMENTS

| | | | | | |
|---|---|---|---|---|---|
| 356,523 | A | * | 1/1887 | Chalifoux | 52/312 |
| 781,376 | A | * | 1/1905 | Sorensen | 144/346 |
| 1,102,036 | A | * | 6/1914 | Ganter | 144/347 |
| 1,562,170 | A | * | 11/1925 | Holstein | 144/347 |
| 1,949,325 | A | * | 2/1934 | Paul | 473/412 |
| 3,992,838 | A | * | 11/1976 | Vizziello | 52/233 |
| 4,332,384 | A | * | 6/1982 | Hasegawa | 473/521 |
| 4,624,295 | A | * | 11/1986 | Howland | 144/347 |
| 5,115,609 | A | * | 5/1992 | Sing | 52/309.9 |
| 5,189,860 | A | * | 3/1993 | Scott | 52/729.4 |
| 5,207,046 | A | * | 5/1993 | Vekkeli | 52/730.7 |
| 5,653,080 | A | * | 8/1997 | Bergeron | 52/729.4 |
| 5,782,046 | A | * | 7/1998 | Karlsson | 52/233 |
| 5,787,675 | A | * | 8/1998 | Futagi | 52/745.1 |
| 5,865,929 | A | * | 2/1999 | Sing | 156/264 |
| 5,870,876 | A | * | 2/1999 | Deiter | 52/731.1 |
| RE36,153 | E | * | 3/1999 | Sing | 52/309.9 |
| 5,881,786 | A | * | 3/1999 | Wilderman et al. | 144/348 |
| 5,888,620 | A | * | 3/1999 | Grenier | 428/172 |
| 5,896,723 | A | * | 4/1999 | Sing | 52/730.7 |
| 5,899,251 | A | * | 5/1999 | Turner | 144/347 |
| 5,968,625 | A | * | 10/1999 | Hudson | 428/54 |
| 6,025,053 | A | * | 2/2000 | Grenier | 144/347 |
| 6,125,607 | A | * | 10/2000 | Poce | 52/730.7 |
| 6,164,027 | A | * | 12/2000 | Ohlund | 52/309.9 |
| 6,266,934 | B1 | * | 7/2001 | Houseal | 52/233 |
| 6,279,629 | B1 | * | 8/2001 | Sing | 144/347 |
| 6,319,046 | B1 | * | 11/2001 | Feye-Hohmann et al. | 439/395 |
| 6,460,583 | B1 | * | 10/2002 | Lindal | 144/347 |
| 6,519,912 | B1 | * | 2/2003 | Eckmann et al. | 52/730.7 |
| 6,543,193 | B2 | * | 4/2003 | Houseal | 52/233 |
| 6,761,009 | B1 | * | 7/2004 | Karlstrom et al. | 52/730.7 |
| 6,817,153 | B2 | * | 11/2004 | Steinberg et al. | 52/592.1 |

FOREIGN PATENT DOCUMENTS

| | | | |
|---|---|---|---|
| EP | 0388507 | A2 | 9/1990 |
| EP | 0518246 | A2 | 12/1992 |
| FR | 1247794 | | 10/1960 |
| JP | 10037348 | | 2/1998 |
| WO | 9104379 | A1 | 4/1991 |

* cited by examiner

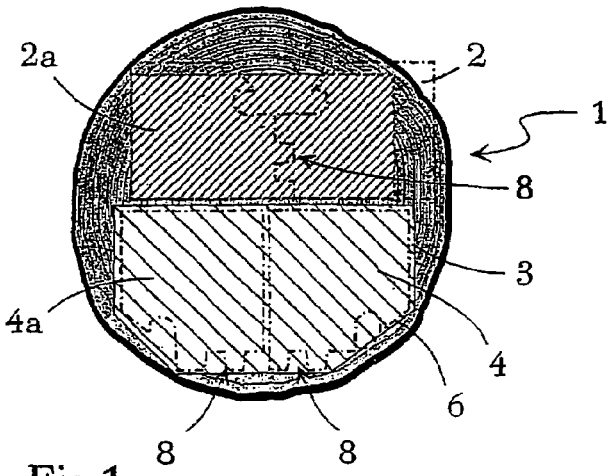
Fig 1
Fig 2
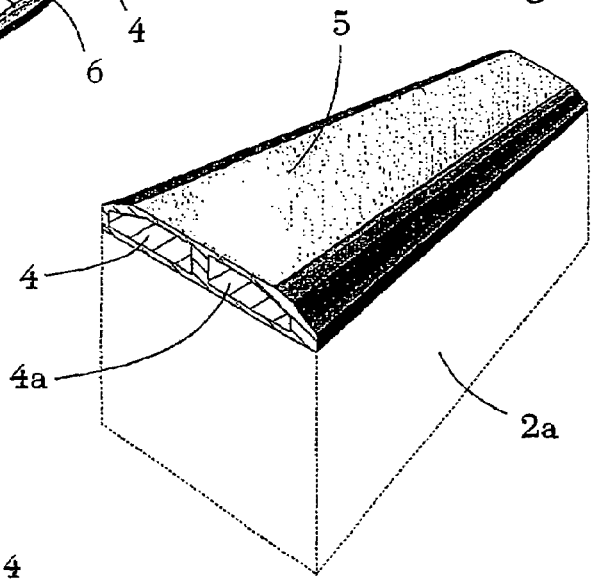
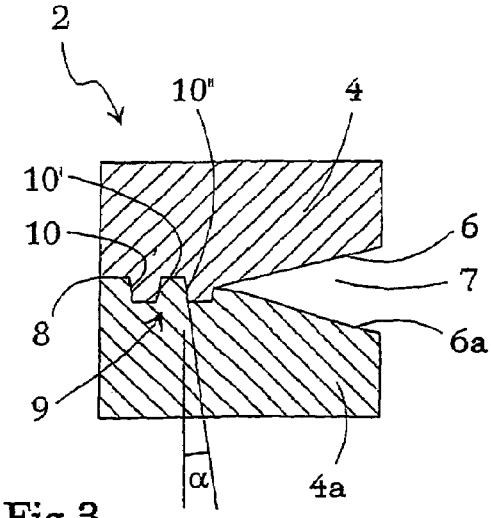
Fig 3
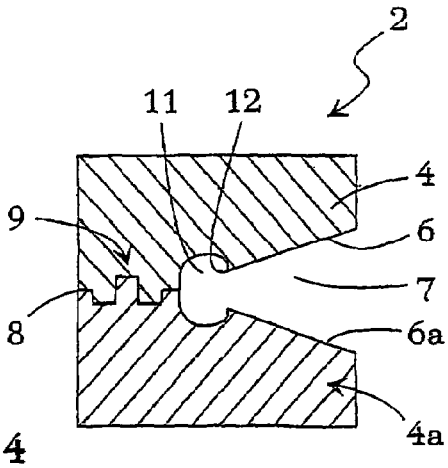
Fig 4

Fig 12
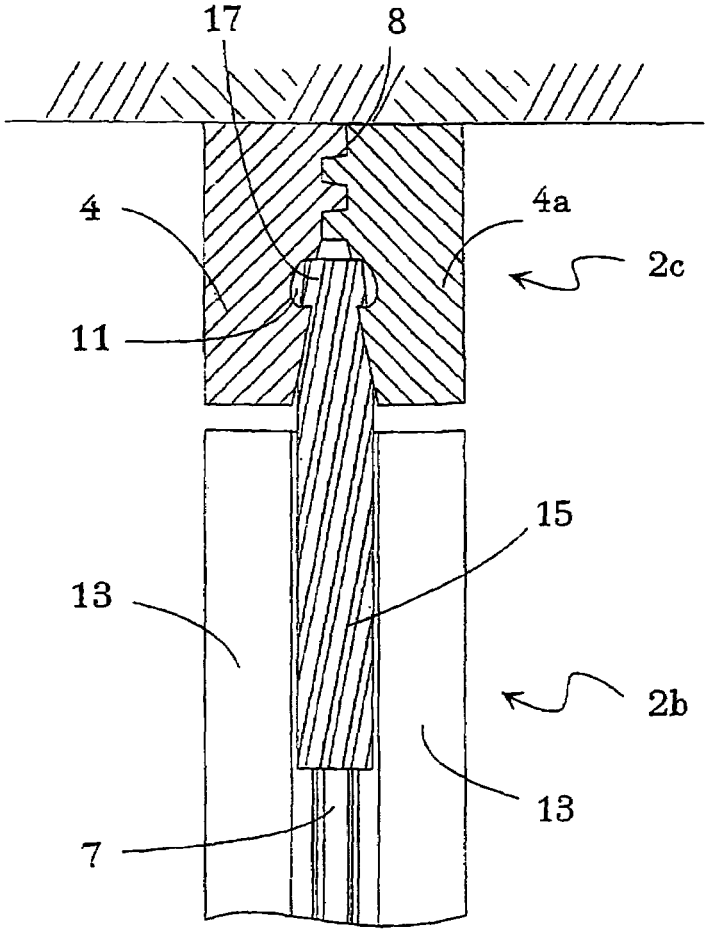
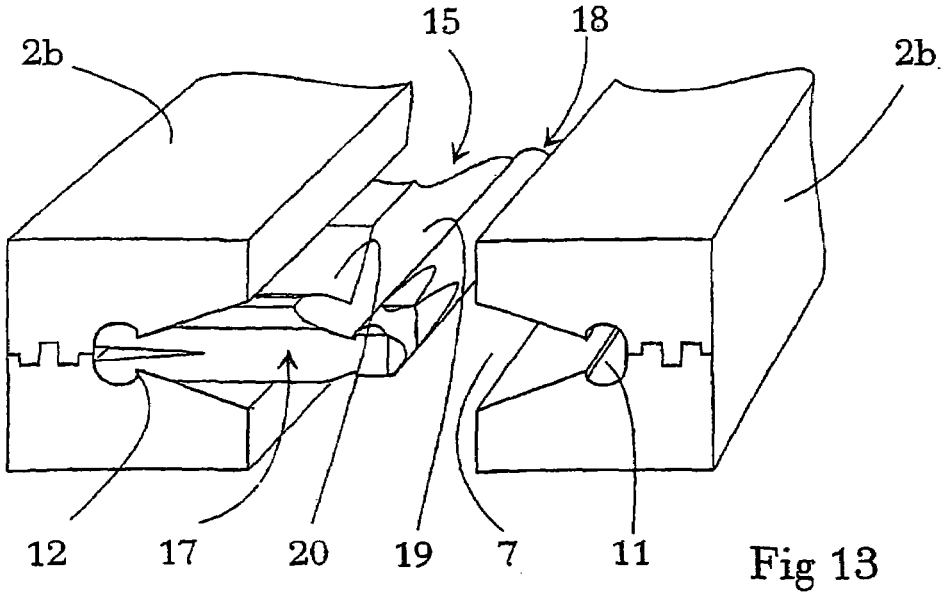
Fig 13

STUD SYSTEM AND METHODS RELATED THERETO

BACKGROUND OF THE INVENTION

Description of the Related Art

Prior art knows different stud systems made of relatively thin sheet metal, wherein the studs usually are designed to have a generally U-shaped cross section. Such studs are used especially for frame structures for partitional walls and like structures, where wall panels based on, for example, waste wood or especially gypsum are attached, for example, by screwing, to the flanges of the vertically erected studs. Such studs are usually attached vertically between corresponding horizontal studs that are arranged at the floor and the ceiling, respectively, in a space where the partitional wall will be erected. Metal studs, however, cause some problems and drawbacks which have been discussed in more detail elsewhere, and instead, it has been proposed that corresponding studs could be made of, for example, wood.

SUMMARY OF THE INVENTION

The present invention relates to a stud system wherein each respective stud includes mutually attached flanges which form a monolithic entity, where the flanges are formed of a wood material so that respective flanges include a longitudinally extending side portion which has a beveled cross section and which is directed towards the inside of the stud. The present invention also relates to a method for manufacturing studs or the like, generally elongated pieces which include opposite flanges, which flanges are formed of a wood material and are glued together in order to constitute a monolithic entity. Further, the present invention relates to a method at stud systems including corresponding studs.

One object of the present invention is to provide a stud system where small dimension wood and such wane edge wood material also can be used, which traditionally cannot be used for full value wood products.

Another object is to disclose such a stud system where the natural properties of wood are used in the best possible manner and are used in order to keep the stud straight and without twisting.

A further object is to use in an optimal manner the available wood material and at the same time to provide a stud system wherein a mutual connection of studs in horizontal and, respectively, vertical direction is facilitated by the design of the stud profile, this without, however, a risk for cracks in the material for this reason.

These and other objects are reached in accordance with the present invention by means of a system and methods having characteristics that are disclosed in the appended claims. Especially, the stud system in accordance with the present invention is characterized in that a side portion at each respective stud flange is designed as a contact surface for an intermeshing co-operation with a corresponding contact surface at an adjacent flange. Again, the inventive method for manufacturing studs is characterized in that the respective stud flange is designed in the form of a first flange strip which includes a first contact surface which, in cross section, is generally toothed and which is arranged in a finger-like intermeshing fashion with a second contact surface having a corresponding shape and which is located at a second flange strip which is designed in a generally corresponding manner. Further, a method in connection with the stud system is characterized in that side portions at the respective opposing flanges are formed to include longitudinally extending tongue and groove structures, after which respective two opposing flanges are pressed together in such a way that opposite tongue and, respectively, groove structures, will be positioned in a mutually intermeshing engagement.

Hereafter, some favorable embodiments of the present invention will be discussed in more detail as examples and with reference to the appended drawings.

BRIEF DESCRIPTION OF THE DRAWINGS

FIG. 1, generally in section, discloses how a timber block for use as studs in accordance with the present invention can be taken out also from round timber having a dimension which is too small for providing full edge studs of a conventional type, FIG. 2, in a perspective view, discloses how material for studs in accordance with the present invention can be formed of the material in wane edge waste wood outside boards obtained when heavier timber logs are sawn, FIG. 3, in section, generally discloses the general principle of the present invention, as well as a stud profile in approximately natural size and shaped according to one embodiment of the present invention, FIG. 4, in the same manner in section, discloses a stud profile according to an especially favorable embodiment of the present invention, FIG. 5, in section, discloses how both flange strips at another especially favorable stud profile according to a further embodiment of the present invention can be taken out from a wane edge batten by means of an especially shaped edge means, FIG. 6, in section, discloses how a flange element of a somewhat heavier type is taken out from a heavier wane edge plank or from a half-round timber block, FIG. 7, in section, discloses a ready-made stud which is composed of flange elements in accordance with FIG. 6, FIG. 8, in perspective, discloses a portion of a stud in accordance with FIG. 8, FIG. 9, in section, discloses an alternative embodiment of the present invention, FIG. 10, also in section, discloses a further stud profile in accordance with the present invention, FIG. 11, in perspective, discloses the general structure of a stud framing based on studs according to one embodiment of the present invention, FIG. 12 discloses the attachment between a vertical stud and a horizontal stud in accordance with a favorable embodiment of the present invention, in order to achieve, for example, a stud framing as disclosed in FIG. 12, and FIG. 13, in more detail, discloses the structure and function of an alternative connector piece for use in accordance with the embodiment disclosed in FIG. 12.

DETAILED DESCRIPTION OF THE INVENTION

Figure 5:
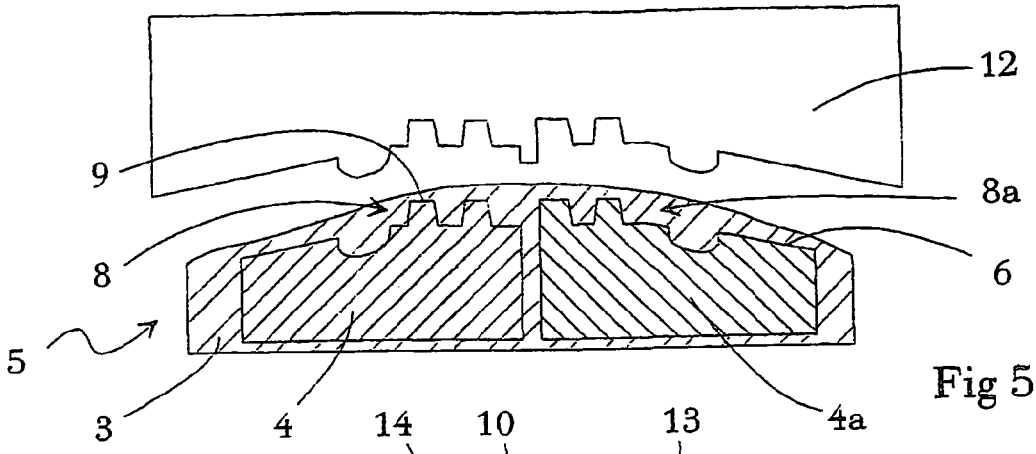

Round timber 1 in accordance with FIG. 1 includes an outer bark layer within which the timber has a generally ring-like structure based on the yearly growth. Due to this structure, wood material has many good specific properties but also, seen from a rational building industry viewpoint, a rather unpractical shape. Thus, a full edge timber block 2*a* must be sized taking in account the shape of the round timber, which results in a waste of wood material having equally good mechanical properties as the full edge timber material, if not, in some cases, even better.

In FIG. 1, the above fact has been illustrated in such a way that a full edge timber block 2*a* having a size that corresponds to the practical maximum size that can be taken out from the disclosed round timber dimension has been indicated in phantom on the round timber block 1. For the sake of simplicity, it is here assumed that the full edge timber block 2*a* corresponds to, for example, a stud dimension of 45×95 millimeters, which is a common dimension for a stud which is planed from a 50×100 millimeter raw stud. In FIG. 1, as a comparison to this full edge timber block 2*a*, the dimensions for a full edge stud 2 have been indicated in semi-dotted line. The full edge stud 2 is composed of opposing flanges in accordance with the present invention and represents the maximum size that can be taken out from this same round timber block 1 using the existing mass of wood. Further, in FIG. 1, a wane edge wood material 3 indicates the corresponding usable mass of wood for this specific embodiment, and here the respective flange strips 4 and 4*a* have been indicated in semi-dotted line which together constitute a full edge stud 2 in accordance with the present invention.

The comparison clearly indicates that by means of the present invention a considerably thicker structurally full edge stud can be obtained from the same timber 1, which stud has a width and, respectively, height, which normally, in relation to corresponding measures for a traditional full edge timber block 2*a*, is larger on the order of 15 to 25% and in some cases even larger, depending on the individual shape of the cross section. This also leads to the advantage that in order to provide composite studs having the same overall dimensions as compact studs one can use, in accordance with the present invention, timber having correspondingly smaller dimensions. Thus, by means of the present invention such a material can be used for structurally important constructions, which material in accordance with prior art technology, could be used for secondary purposes or, in worst case, as firewood. For example, the bending strength for a stud is to a higher power depending on the dimension of the wood piece in a direction transverse to the bend, and thus, the material at the full outer edges of a stud has a great importance for the bending strength. The material close to the central axis, again, lacks any essential importance for this strength. For this reason, it is clear that such an insignificant reduction of the stud's functional cross area, due to the groove which extends in the stud, clearly is compensated by the advantages of a stud where the direction of the material as such provides a better bending strength and where the stud has better dimensional stability. Further, this groove can be effectively used for attaching studs in a manner that previously had been impossible without special additional measures. Thus, a stud in accordance with the present invention has a clear added value in relation to such full edge studs that merely have been taken out from the timber block 1.

FIG. 2 discloses another example of how opposing flanges 4, 4*a* can be taken out from a timber block, in this case, a wane edge plank 5 of a suitable thickness which has been obtained when a full edge timber block 2*a* has been sawn out from round timber block 1.

FIG. 3 discloses an example of a stud 2 in accordance with one embodiment of the present invention. This stud 2 includes two opposing flanges 4, 4*a* having one respective side which is straight while a second side portion shows a profile that includes a bevelled inner edge 6 and 6*a*, respectively, between which edges is formed a generally wedge-shaped groove 7 which can be used for the attachment of the stud 2 as will be described in more detail below. The flanges 4, 4*a* are mutually directly interconnected along a contact surface 8. In accordance with the present invention, the contact surface 8 includes a profiling 9 that is generally toothed in cross section and, respectively, has a tongue-and-groove structure in the longitudinal direction so that the profiles at respective opposing flanges 4, 4*a* can be brought into a close mutual intermeshing relationship. FIG. 3 further discloses that the respective co-operating opposing flanges 4, 4*a* is designed as a piece which in cross section is slanting but otherwise rectangular and in some cases square, so that the contact surface 8 is formed at a side which is adjacent to the tapered side 6, 6*a*.

Thus, at a stud, in accordance with the present invention, the profiling 9 includes generally tongue-like and, respectively, groove-like formations that extend in the stud's longitudinal direction. At both opposing flanges 4, 4*a* the formations include at least 3 co-operating opposite engagement surfaces 10, 10' and 10", so that the intermeshing surfaces are designed, in practice, to mutually interlock by means of the friction between the opposite surfaces. Preferably, the co-operating surfaces 10, 10', 10" are slightly inclined so that an angle à is in the order of 5° to 15°, preferably about 7°, between the surface planes and a plane that is transverse in relation to the general extent of the contact surface and extends in the longitudinal direction of the stud. Thus, in the embodiment disclosed in FIG. 3, the profiling 9 at each respective opposing flanges 4, 4*a* comprises planar slightly inclined engagement surfaces 10, 10', 10" that in cross section are arranged conically, but also other types of self-locking surface formations can be imagined within the inventive idea.

According to a favorable embodiment of the present invention, two opposing flanges 4, 4*a* are interconnected by pressing the tongue-and-groove formations 9 of the contact surfaces 8 so that a locking is obtained between co-operating sides surfaces 10, 10', 10" of the tongues and the grooves. A glue is at one or both surfaces, which glue connects the opposing flanges 4, 4*a* to a monolithic entity, specifically the stud 2. At the same time, the glue acts as a lubricating means that facilitates the pressing together of the opposing flanges 4, 4*a*. The contact surfaces 8 of the flanges are arranged in such a way that a sufficient locking between the surfaces 8 takes place already during the pressing so that the glue's consolidation can take place at a later stage, for example, at its own pace after the studs 2 have been packed. Such a design facilitates a high manufacturing speed.

Due to the co-operation between the three self-locking intermeshing surfaces 10, 10', 10" the stud 2 itself maintains the straight shape into which it is forced during the compression of the opposing flanges 4, 4*a*. The flange material is constituted by opposing portions of the same round timber block 1 or wane edge block 5, and in this manner any inherent bending tendency of the wood material in one opposing flange 4 is compensated by the fact that the co-operating opposing flange 4*a* has an inherent bending tendency that is directed in the opposite direction. This stability in shape is achieved due to the co-operating intermeshing surface's three-dimensional character usually in both transverse directions of the stud. By means of a system in accordance with the present invention the co-operating glue surfaces will be large, usually about 50% larger than for such planar contact surfaces, which normally are used when strip-like wooden pieces are glued together, and this also increases the breaking strength.

FIG. 4 discloses an especially favorable embodiment of the present invention, wherein the generally wedge-like groove 7 between the inclined flange surfaces 6, 6*a* has been supplemented with an additional groove 11 which extends in the longitudinal direction of the stud and at the bottom of the groove 7. This additional groove 11, which is the object of a parallel patent application, extends in the groove 7 laterally into the flange material 4, 4*a*, and thus the intersection between the groove 11 and the planar bevelled flange inner side 6, 6*a* constitutes a retaining edge 12 having a function which will be discussed later on.

FIG. 5 discloses how two respective co-operating flanges 4, 4*a*, by means of one or several specifically designed cutter blades 12, are suitably planed or milled from, for example, a half-round basic material 5. By means of the active shape of the blade 12 the profiling 9 for the flange's 4, 4*a* respective contact surfaces 8, 8*a* are shaped so that they mutually co-operate to form a monolithic entity. FIG. 5 also discloses the fact that the flange strips 4, 4*a*, according to the present invention, have an asymmetrical design that, again, provides a symmetrical end product.

Figure 6:
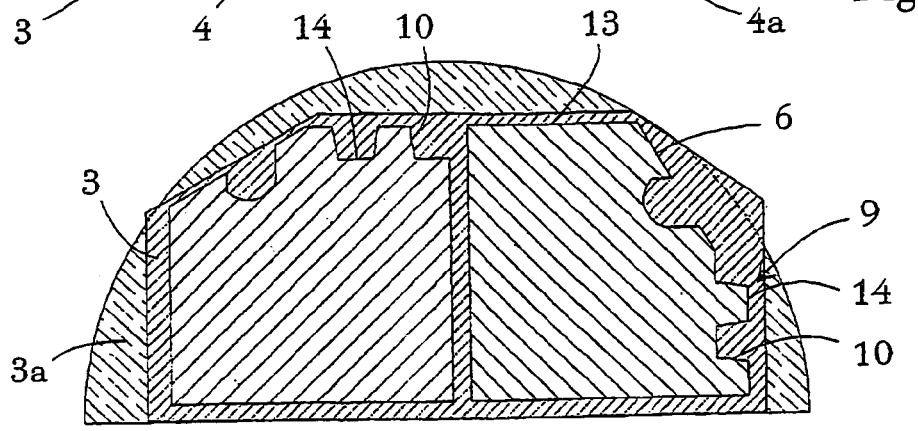

By means of a carefully balanced design of the tongue-and-groove profiling 9 the wood material available in a round timber block 1 of different dimensions can be optimally used. In FIG. 1, it can be observed that the useful wood material 3 in fact, for the profile disclosed, is not quite centered in relation to the cross surface area of the round timber 1. Accordingly, it is sometimes appropriate to make the tongue-and-groove profiling 9 at opposite sides of the wood material 3 instead of at the same side as disclosed, for example, in FIG. 5. For certain profile designs, the optimal profiling may be evenly distributed along the circumference of the round timber 1 so that each side of the timber is machined in order to form a straight flange edge 13, a slantingly profiled flange side 6, 6*a* and a toothed contact surface 9. FIG. 6 discloses such a system and further that flange strips 4, 4*a* for studs 2 in accordance with the present invention can be formed of both naturally rounded wood material 3*a* and of a wood material 3 which, for example, has been provided by splitting wane edge wood material.

Figure 7:
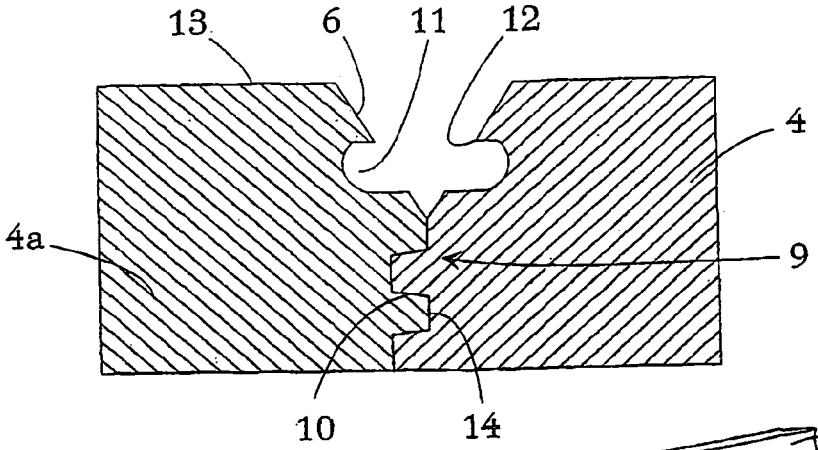
Figure 8:
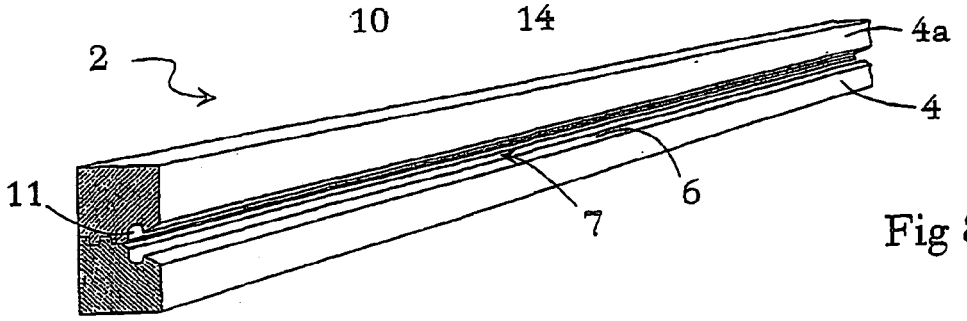

In FIG. 7, an example is disclosed in cross section of how a common stud of standard dimensions has been achieved by a profiling as disclosed in FIG. 6. FIG. 8 discloses, as a perspective view, a section of the same stud, showing how the longitudinal groove 7 and the additional groove 11 run in the stud's 2 whole length. Usually, it is appropriate to directly give the stud its final dimensions, but in some cases it may be of advantage to primarily dimension the studs to include, at least in one direction, a slightly larger dimension than the final one, in which case the stud, for example, after the gluing, is machined to obtain the final desired dimensions.

Figure 9:
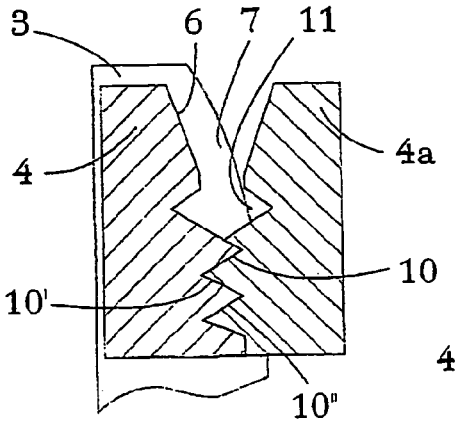
Figure 10:
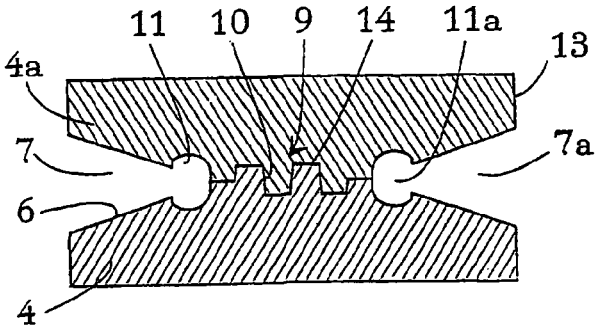

FIGS. 9 and 10 disclose examples of alternative embodiments of the present invention, wherein the stud flange profiles 4, 4*a* include a generally toothed contact surface without the planar intermediate surfaces 14 which are typical for the other embodiments, see for example FIG. 6, and which extend between the co-operating intermeshing surfaces 10, 10', 10" generally parallel to one flange surface. Again, FIG. 10 discloses a stud profile having two opposite grooves 7, 7*a* and, respectively, two opposite additional grooves 11, 11*a*.

Figure 11:
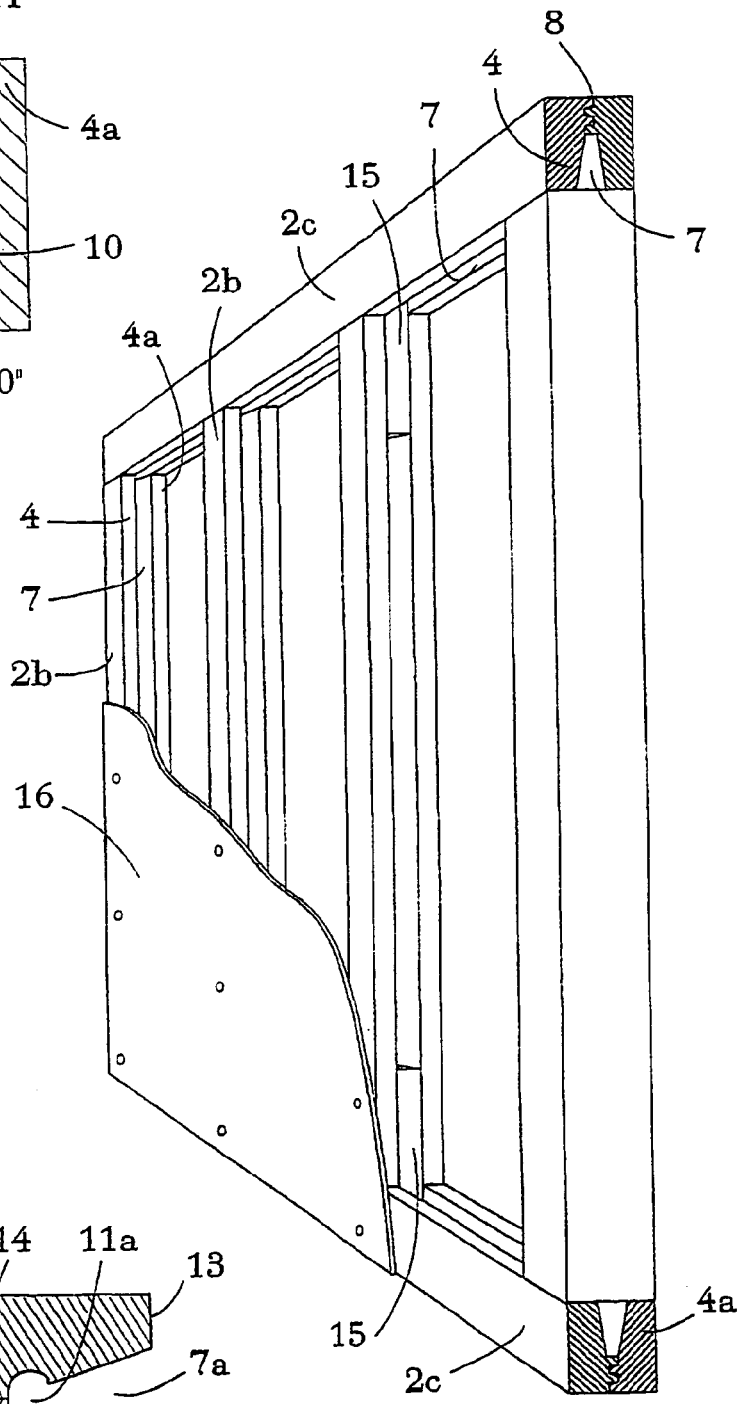

FIG. 11 generally discloses how a stud structure such as the framework for a partitional wall or the like is built up of studs 2 in accordance with the present invention. Here, the stud structure suitably includes generally vertical studs 2*b* which at their ends are attached to horizontal studs 2*c* which usually, but not always, are attached to the floor and the ceiling, respectively, in the space where the partitional wall will be erected. FIG. 11 discloses a connection including special connector pieces or elements 15 which are generally wedge-shaped in two directions and which co-operate with the grooves 7 in the vertical and the horizontal studs 2*b* and 2*c*, respectively. These co-operating wedge-shaped connector pieces 15 are nailed, glued or attached in some other manner in the respective groove and they prevent the studs 2*b* from displacement when wall boards 16 made of gypsum or the like are attached on the stud, usually by screwing them to the stud flanges 4, 4*a*.

FIGS. 12 and 13 disclose an alternative attachment method which uses the additional groove 11 which has been mentioned above. In this embodiment, a specially designed separate connector element 15 is used, which element extends in the additional groove 11 in a first stud 2*a* and which, for example, by striking or turning is introduced so that one end 17 and/or edge 18 of the connector element 15 will be positioned in the additional groove 11 in a second stud 2*c*, suitably behind the retaining edge 12. In some cases, the introduction includes that the end 17 and/or a portion of the retaining edge 12 will be slightly deformed. By means of this system a very rigid connection is achieved between vertical and horizontal studs 2*b* and 2*c*, respectively, while at the same time the connection with respect to its nature is such that the horizontal position of the vertical studs 2*b* can be adjusted to some extent at a later stage by repositioning the stud in a lateral direction. In some embodiments the attachment system disclosed renders possible that studs 2*b* are detached also after the attachment.

Further, in some embodiments the connector element 15 can be used for attaching studs to each other in a parallel disposition and/or for attaching details such as electrical boxes, door frames and the like (not shown) to the studs 2, 2*b*, 2*c*. Here, FIG. 13 discloses an example of an appropriately designed connector element 15 which includes both a longitudinally extending profiling 19 of an edge 18 which is preferably arranged for continuous intermeshing in the groove in a first stud 2*b*, as well as an end profiling 20 for a corresponding intermeshing into a transverse second stud 2*c* (not shown in the Figure). Since the connector element 15 preferably is double-sided and comprises two identically shaped edges 18 it can also be used for attaching studs 2*b* in a parallel manner as generally disclosed in FIG. 13.

Above, some favorable embodiments of the present invention have been described with reference to certain examples, but for the professional it is clear that the invention is applicable also in many other ways within the scope of the appended claims.

The invention claimed is:

1. A stud system comprising:

studs including flanges which are attached directly to each other and which constitute an essentially monolithic entity, wherein said flanges are formed of a wane edge wood material, each respective flange including a longitudinal first side portion which is bevelled in cross-section and which is directed towards an interior region of the stud, and a second side portion which adjoins said bevelled first side portion constitutes a contact surface for co-operation with a corresponding contact surface of an adjacent flange, and wherein the contact surfaces of opposing flanges include cooperative surface structures which constitute an intermeshing tongue-and-groove structure interconnecting said opposing flanges.

2. A stud system as defined in claim 1, wherein said intermeshing tongue-and-groove structure locks said contact surfaces of said opposing flanges together based on friction between longitudinally extending sides of said tongue-and-groove structure, wherein said sides are inclined 5° to 15° relative to a plane which is transverse in relation to a respective plane of said contact surfaces.

3. A stud system as defined in claim 1, wherein said respective flanges include a separate additional groove arranged in opposing bevelled side portions, wherein said groove receives a separate connector element which is longitudinally movable within said groove.

4. A method for manufacturing studs and elongated pieces having opposite flanges formed of a wane edge wood material and which are glued together to form a monolithic entity, the method comprising:

forming each respective flange to have a shape of a first flange strip, which includes a first contact surface having a generally toothed cross section; and arranging said first contact surface in a finger-like intermeshing relationship with a second contact surface which is formed in a corresponding manner at a second flange strip to have a generally corresponding shape.

5. A method as defined in claim 4, wherein the forming step comprises forming each flange strip as a slantingly bevelled quadratic piece wherein said contact surface is formed at a side adjacent relative to the bevelled cut side.

6. A method as defined in claim 4, wherein said contact surface is shaped as tongue- and has a tongue-and-groove shaped formation wherein each respective strip edge includes at least three co-operating intermeshing surfaces which are inclined 5° to 15° relative to a plane transverse in relation to a general plane of the contact surface.

7. A method as defined in claim 4, further comprising dimensioning studs having, at least in one direction, a slightly larger dimension and machining the stud after gluing to obtain a final dimension.

8. A method as defined in claim 4, wherein the forming step comprises selecting flange strips having opposite positions in round timber, to form the final shape of the stud.

9. A method of forming stud systems, each respective stud including flanges attached directly to each other and which define a monolithic entity, said flanges being formed of wane edge wood material wherein each respective flange includes a bevelled longitudinal side portion in cross section, the method comprising:

forming one side portion at each respective opposite flange to include longitudinally extending tongue-and-groove shaped formations, and pressing together each respective opposite flange so that said respective opposite tongue-and-groove shaped formation is positioned in a mutual intermeshing position, wherein longitudinally extending side portions of the tongue-and-groove shaped formation are formed wherein said intermeshing defines a force transmissive connection between said flanges, said connection being based on friction between said longitudinal side portions of the intermeshing tongue-and-groove shaped formations and said sides have an inclination of 5° to 15° relative to a plane which is transverse in relation to the general extent of said structure.

10. A method as defined in claim 9, further comprising:

applying an additional glue material between said intermeshing tongue-and-groove shaped formations.

* * * * *